United States Patent [19]

Little et al.

[11] Patent Number: 4,705,108

[45] Date of Patent: Nov. 10, 1987

[54] METHOD FOR IN SITU HEATING OF HYDROCARBONACEOUS FORMATIONS

[75] Inventors: William E. Little, Morgantown, W. Va.; Thomas R. McLendon, Laramie, Wyo.

[73] Assignee: The United States of America as represented by the United States Department of Energy, Washington, D.C.

[21] Appl. No.: 867,125

[22] Filed: May 27, 1986

[51] Int. Cl.[4] ..... E21B 43/24; E21B 43/267

[52] U.S. Cl. ..... 166/248; 166/280; 166/302; 166/308

[58] Field of Search ..... 166/248, 65.1, 302, 166/308, 280, 259

[56] References Cited

U.S. PATENT DOCUMENTS

| | | | |
|---|---|---|---|
| 3,106,244 | 10/1963 | Parker | 166/248 |
| 3,137,347 | 6/1964 | Parker | 166/248 |
| 3,149,672 | 9/1964 | Orkiszewski et al. | 166/248 |
| 4,140,180 | 2/1979 | Bridges et al. | 166/248 |
| 4,144,935 | 3/1979 | Bridges et al. | 166/248 |
| 4,265,307 | 5/1981 | Elkins | 166/248 |
| 4,401,162 | 8/1983 | Osborne | 166/248 |
| 4,470,459 | 9/1984 | Copland | 166/248 |
| 4,550,779 | 11/1985 | Zakiewicz | 166/248 |

OTHER PUBLICATIONS

Mallon, Richard G., "Economics of Shale Oil Production by Radio Frequency Heating," 5-7-1980, U.S. Dept. of Energy.

Carlson, R. D. et al., "Developement of the IIT Research Institute RF Heating Process for in situ Oil Shale/Tar Sand Fuel Extraction—An Overview", Aug. 1981, 14th Oil Shale Symposium Proceedings.

*Primary Examiner*—Stephen J. Novosad
*Assistant Examiner*—Bruce M. Kisliuk
*Attorney, Agent, or Firm*—L. E. Carnahan; Harold M. Dixon; Judson R. Hightower

[57] ABSTRACT

A method for extracting valuable constituents from underground hydrocarbonaceous deposits such as heavy crude tar sands and oil shale is disclosed. Initially, a stratum containing a rich deposit is hydraulically fractured to form a horizontally extending fracture plane. A conducting liquid and proppant is then injected into the fracture plane to form a conducting plane. Electrical excitations are then introduced into the stratum adjacent the conducting plate to retort the rich stratum along the conducting plane. The valuable constituents from the stratum adjacent the conducting plate are then recovered. Subsequently, the remainder of the deposit is also combustion retorted to further recover valuable constituents from the deposit. Various R.F. heating systems are also disclosed for use in the present invention.

20 Claims, 5 Drawing Figures

●-Shorting production well
O-Non shorting production well
u-Upper hydrofract well
L-Lower hydrofract well
~-Exciter well

METHOD FOR IN SITU HEATING OF HYDROCARBONACEOUS FORMATIONS

FIELD OF THE INVENTION

The present invention relates generally to the extracting of valuable constituents from an underground hydrocarbonaceous deposit, and more particularly to the hydraulic fracturing of a stratum of the deposit containing a rich deposit and the heating of this stratum by electrical excitations.

BACKGROUND OF THE INVENTION

There are billions of barrels of potential liquid hydrocarbons in heavy crude formations or reservoirs, tar or oil sands in California and other places, and oil shale basins in Wyoming and Utah that are currently unprofitable to exploit for a number of reasons. Among these reasons are the following: they will not flow at ambient conditions where they are found; they are inaccessible or are accessible only with great difficulty and/or expense; further in the case of shales the average Fisher assay is less than 20 gpt; the resource has some rich strata (20 gpt or greater) but most of it is too lean to economically mine; where the resource is rich on the average, there is not enough of the total resource to economically mine; and there is too much overburden to use the technique of lifting the overburden by blasting to produce permeability and rubbilization, such as is done in the Geokinetics process.

Several attempts have been made to extract this type of resource by true in situ combustion. Unfortunately, the results have been poor. Research has shown that it is not possible to combustion retort "smooth" shale surfaces whether in slots, holes, or chunks without the presence of some fine rubble. The amount of fine rubble needed may be as low as 5% of the total resource.

There have also been attempts to increase the in situ permeability by explosive fracturing. Even fracturing by electricity has been tried.

One promising method of recovering valuable constituents from an oil shale deposit in situ is disclosed in U.S. Pat. Nos. 4,140,180 (Bridges et al) and No. 4,144,935 (Bridges et al). This process is also disclosed in *Economics of Shale Oil Production By Radio Frequency Heating* by R. Mallon, report no. UCRL-52942, Lawrence Livermore Laboratory, Livermore, California, May, 1980; and in "Development of the IIT Research Institute RF Heating Process For In Situ Oil Shale/Tar Sand Fuel Extraction-An Overview", by R. Carlson, E. Blase, and T. McLendon, *Fourteenth Oil Shale Symposium Proceedings,* Colorado School of Mines, Golden, Colorado, April, 1981. According to this process, the oil shale is processed in situ without being rubbled or explosively fractured. Metal electrodes are inserted in a set of vertical drill holes and are energized by a group of RF oscilators. The holes bound a block of shale that is to be retorted. The electric field is developed in such a way that heating within the block is almost uniform, and heating outside of the block is very low. Retorting of the shale results in a pressure build up of the hydrocarbon fluids. The oil and gas move horizontally (parallel to bedding planes), then down the electrode holes to a collection manifold. Preferably, off-peak electric power is used from existing generating stations to operate the oscillators and to keep down the costs.

This RF heating process makes use of a basic triplate transmission line concept. This triplate line heating plate concept is adaptable to a wide variety of resource materials by careful selection of the electrode array configuration and by adjusting the RF frequency to the specific dielectric of the resource. In general, the triplate electrodes consists of rows of metal pipes inserted into holes drilled either from the surface or from drifts mined into the deposit in question. The tubular electrodes may also be useful in providing an exit path for the hydrocarbonaceous products liberated by heating.

Removal of the kerogen without combustion leaves a condition of typically 15% voids with about 3% of the organic carbon left as char. This process suffers from the very great expense of having to accurately drill the triplate array holes. In addition, the process is funamentally limited to effecting a relatively small horizontal distance. Thus, in order to fully exploit a shale resource that is spread horizontally but relatively thin vertically, an RF process other than this must be available.

The recovery of shale oil has been discussed in detail and at great length because of the greater complexities thereof; however, the invention has more immediate application to heavy crudes and tar sands because the quantity and degree of heating is much less than with oil shale. However, delivering large quantities of heat, efficiently and economically for heavy crudes and tar sands has presented great problems not fully satisfied by the prior art methods.

SUMMARY OF THE INVENTION

In accordance with the present invention, a method for extracting valuable constitutents from an underground hydrocarbonaceous deposit such as heavy crudes, tar sands and oil shale is disclosed. According to the method, the deposit is initially hydraulically fractured along a stratum which contains a rich deposit in order to form a horizontally extending fracture plane. The hydraulic fracturing fluid is conducting and contains a conducting proppant. Electrical excitations are then introduced into this stratum adjacent the conducting plate. The electrical excitations are continued to retort the stratum along the conducting plate. The valuable constitutents are then recovered from the stratum.

In order to fully develop the deposit, the process preferably also includes the combustion retorting of the deposit adjacent the stratum after the recovery of the valuable costitutents generated by the electrical retorting. If needed, the deposit adjacent the stratum is initially explosively fractured prior to combustion retorting to decrease the voids in the electrically retorted stratum and to increase the voids in the remainder of the deposit adjacent the stratum. Where appropriate, the stratum can also be initially combustion retorted prior to explosive fracturing to generate additional voids in the stratum.

In one embodiment of the present invention, the conducting liquid and proppant injected into the fracture plane is a good conductor such that a conductor plate is formed in the fracture plane. As is conventional in the hydraulic fracturing art a proppant is included to prevent premature closure of the fracture. A proppant which is conducting (e.g. coke particles) is appropriate to achieve the desired conductance when the liquid and proppant are in place. The electrical excitation device is then connected to this conductor plate so that the stratum retorted is adjacent either side of the conductor plate. Alternately, the stratum can be hydraulically fractured at a second location to form a second horizontal fracture plane which is then injected with a good conducting fluid to form a second horizontal conductor plate. Then, both conductor plates are connected to the electrical excitation device so that the stratum retorted lies between the two conductor plates. In another alternative embodiment, a total of three conductor plates are provided with the top and bottom connector plates connected to the electrical excitation device and the middle conductor plate also attached to the electric excitation device. In this manner, the stratum retorted lies between the top and bottom conductor plates.

Instead of connecting the electrical excitation device directly to one or more liquid filled fracture planes, two liquid filled fracture planes can be provided to form a waveguide. Then, an antenna for the electrical excitation device is located between the two fracture planes in the waveguide so that the stratum retorted lies principally between the two fracture planes. Where the fracture planes are filled with a high dielectric constant liquid, the electric excitations in the waveguide can be shaped to a predetermined horizontal area by drilling a plurality of wells to the lower fracture plane and by shorting the waveguide with the wells in a predetermined pattern. Conveniently, the valuable constituents can be recovered through the shorting wells. In addition, a plurality of additional recovery wells can be provided to the upper fracture plane.

It should be appreciated that in order to initially identify the rich deposits in the underground hydrocarbonaceous deposits, the deposit is initially cored. From this coring, the strata containing rich deposits can be identified and appropriately developed.

It is an object of the present invention to provide an economic and efficient process for fully developing a hydrocarbonaceous deposit (i.e. heavy oil or crude, tar sands and shale oil). It is a further object of the present invention to provide a method for developing large fields of a hydrocarbonaceous deposit. These hydrocarbon deposits may also be tar sands, or heavy oils where heat input is required to lower the viscosity to enable the liquids to flow and be recovered without mining the formation to recover the hydrocarbonaceous deposit.

Other features, objects, and advantages of the present invention are stated in or apparent from a detailed description of presently preferred embodiments of the invention found hereinbelow.

DETAILED DESCRIPTION OF THE PREFERRED EMBODIMENTS

Figure 1:
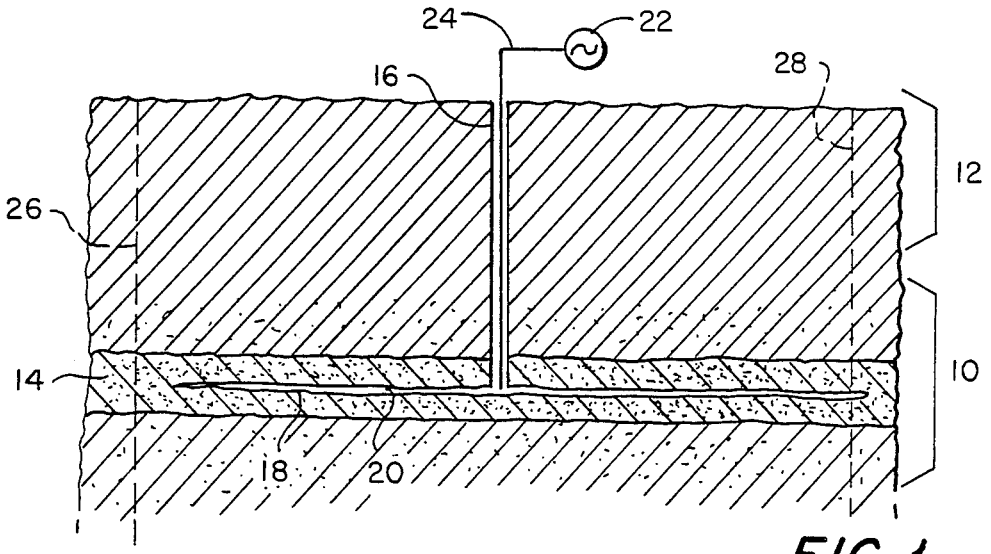
FIG. 1 is a schematic elevation view of an underground deposit in which a single conductor plate embodiment of the present invention is depicted.

With reference now to the drawings in which like numerals represent like elements, the present invention will now be described with respect to the embodiment depicted in FIG. 1. Shown in FIG. 1 is a cross-sectional elevation view of an oil shale deposit 10 which is covered by an overburden 12. Oil shale deposit 10 includes a rich stratum 14 which, for example, has at least 15 gpt. The location of rich stratum 14 and of oil shale deposit 10 is intially determined by coring. It should be appreciated that additional rich strata may also be located in oil shale deposit 10 which are similarly located by the coring.

After determining the location of rich stratum 14, a well 16 is drilled into or traversing rich stratum 14. Rich stratum 14 is then hydraulically fractured to form a horizontally extending fracture plane 18. Thereafter, a good conducting liquid is injected into fracture plane 18 to form a conductor plate 20. A suitable good conducting fluid is waste refinery coke slurry in salt water. Salt water is suitable and even has advantages in electrical properties but the salt also raises the boiling point of the water which slows the rate of loss from the fracture. It should be appreciated that the hydraulic fracturing of rich stratum 14 to form fracture plane 18 provides an approximately circular fracture plane 18 in rich deposit 14.

Conductor plate 20 is then electrically connected to a suitable R.F. generator by a cable 24. The coupling of cable 24 to conductor plate 20 is suitably made by a conducting device similar to a downhole caliper.

In this embodiment, relatively shorter wave lengths of electrical excitations are generated by R.F. generator 22 and radiated by conductor plate 20 into rich stratum 14. By a suitable choice of wave length, substantially all of the absorption of the radiation occurs in rich stratum 14. As the electrical excitation of rich stratum 14 continues, rich stratum 14 is retorted which results in a pressure build up of the hydrocarbon fluids. These heated hydrocarbon fluids can then be recovered through well 16, or other wells suitably positioned with respect to rich stratum 14.

It should be appreciated that the hydraulic fracture used to create conductor plate 20 need not be completely continuous because relatively long wave length radiation is used to heat the surrounding material. As indicated in the prior art references mentioned above, the radio frequency heating process described in these references has clearly demonstrated that periodically spaced conductors are usable to represent a continuous plate. Thus, even a somewhat discontinuous conductor plate will similarly represent a continuous conductor plate for purposes of dielectric heating of the surrounding material. It should further be appreciated that even a discontinuous conductor plate more closely represents a continuous planar conductor than the series of spaced conductors used in the prior art mentioned above.

It should further be appreciated that oil shale strata and the like are generally fairly uniform horizontally, but not vertically. Thus, the use of a horizontal conductor plate created by horizontal hydraulic fracturing allows the best positioning of the conductor plate to dielectrically heat the relatively uniform horizontal stratum thereabout.

After rich stratum 14 and any other rich stratums existing in oil shale deposit 10 have been electrically retorted, the remainder of oil shale deposit 10 is then exploited. After the electrical excitation retorting of rich stratum 14, rich stratum 14 should be at least 10% voids with about 3% char (coke) and at a temperature of about 700°-800° F. With this configuration, the remainder of the shale bed deposit can be combustion retorted by using an air injection well 26 and a production well 28.

It should be appreciated that in order to combustion retort a shale bed, a minimum voidage in the shale bed is required to prevent closure of fissures due to thermal expansion of the shale. If needed, blasting charges are placed inside the unretorted shale to explosively fracture the unretorted shale and force the unretorted shale to compact the retorted shale of rich stratum 14. This increases the voids in the unretorted shale and greatly decreases the voids in the retorted bands.

If the total void of the shale bed deposit is less than 5% or so, it is necessary to first combustion retort rich stratum 14 to burn off the char and remove some of the kerogen to generate additional void. In order to accomplish this, air injection well 26 and production well 28 can also be used. It should be appreciated that the removal of the char also weakens the spent shale. Combusion is made possible because of the hot activated char already present and the increased permeability. This combusion retorting of the rich stratum increases voids, decreases strength of the spent shale, and increases the temperature of the shale bed on the average. Depending upon the total voids created, blasting ray further be necessary before the entire deposit is combustion retorted as explained above.

Figure 2:
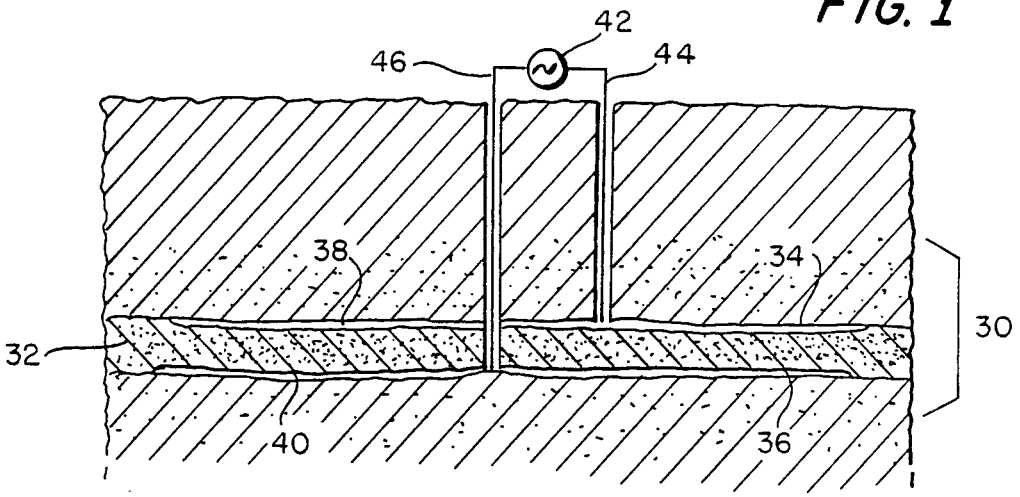
FIG. 2 is a schematic elevation view of a deposit in which a double conductor plate embodiment of the present invention is depicted.

Depicted in FIG. 2 is an alternative embodiment of an electrical excitation system for extracting valuable constituents from an oil shale deposit 30 containing a rich stratum 32. In this embodiment, rich stratum 32 is hydraulically fractured at the boundaries of rich stratum 32 to provide fracture planes 34 and 36. Fracture planes 34 and 36 are then filled with a suitable conducting liquid to form conductor plates 38 and 40, respectively. Conductor plates 38 and 40 are then connected to a suitable R.F. generator 42 by respective cables 44 and 46.

In operation, conductor plates 38 and 40 form a two plate or capacitive representation of wave guides. The process of retorting is essentially the same as that depicted in FIG. 1, except that longer wave lengths are used. The R.F. heating is substantially limited to the area between conductor plates 38 and 40.

Figure 3:
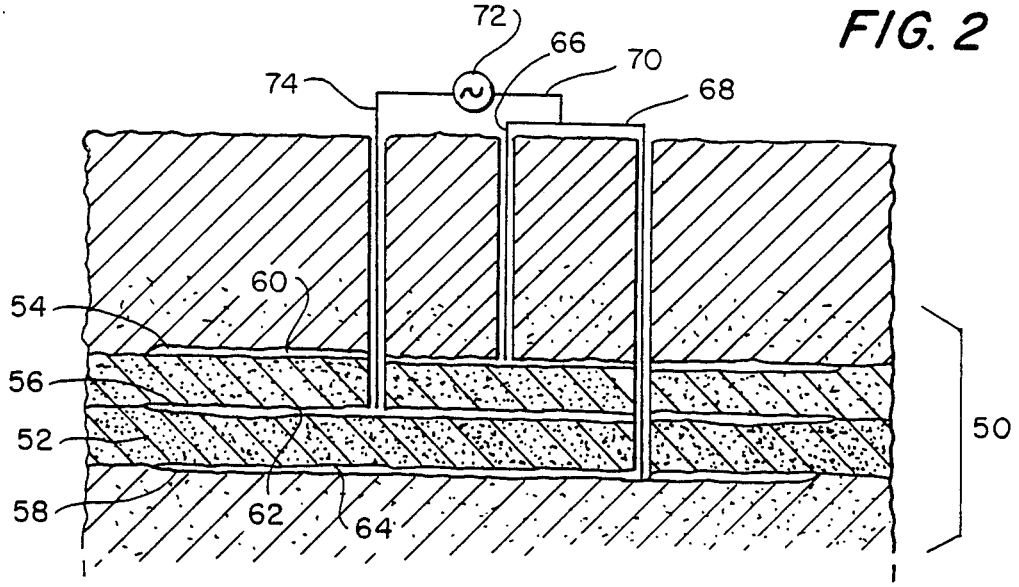
FIG. 3 is a schematic elevation view of a deposit in which a triplate embodiment of the present invention is depicted.

Depicted in FIG. 3 is still another alternative embodiment of an R.F. heating system according to the present invention. In this embodiment, oil shale deposit 50 includes a rich stratum 52. Three fracture planes 54, 56 and 58 are provided in rich stratum 52 to form conductor plates 60, 62, and 64 respectively. As shown, conductor plates 60 and 64 have cables 66 and 68 running therefrom to a common cable 70. Cable 70 is then connected to R.F. generator 72 as shown. Conductor plate 62 is also connected via cable 74 to R.F. generator 72.

The embodiment depicted in FIG. 3 forms a triplate type of R.F. heating system with which rich stratum 52 is heated. Rich stratum 52 is heated between conductor plate 60 and conductor plate 64.

Figure 4:
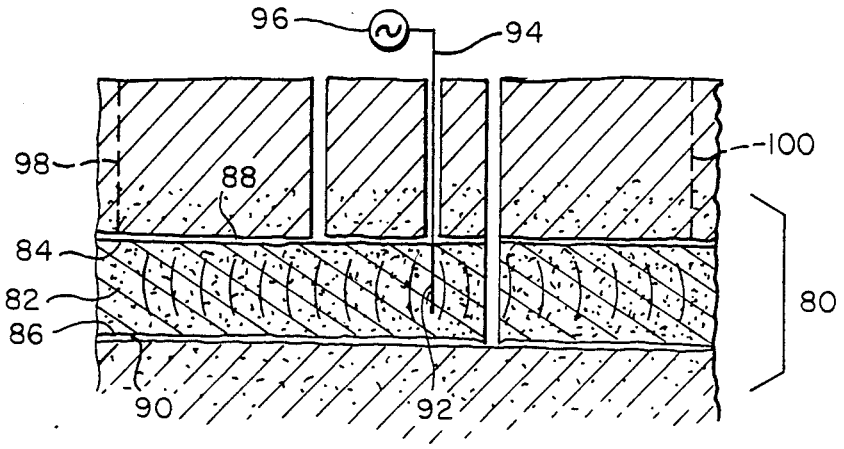
FIG. 4 is a schematic elevation view of a deposit in which a wave guide embodiment of the present invention is depicted.

Depicted in FIG. 4 is yet another embodiment of an R.F. heating system according to the present invention. In this embodiment, oil shale deposit 80 includes a rich stratum 82 as shown. Oil shale deposit 80 is hydraulically fractured to form fracture planes 84 and 86. Fracture planes 84 and 86 are then filled with a suitable liquid to form plates 88 and 90. Fracture planes 84 and 86 can be filled with a good conducting fluid or with a high dielectric constant fluid. In any event, plates 88 and 90 form a waveguide. An antenna 92 is then located between plates 88 and 90. Antenna 92 is connected by cable 94 to an R.F. generator 96 as shown.

In operation, antenna 92 transmits suitable electromagnetic radiation between plates 88 and 90 which form a waveguide. Rich stratum 82 between plates 88 and 90 is then heated by this radiation.

Heating in the horizontal dimension between plates 88 and 90 can be controlled by the horizontal dimension of plates 88 and 90 or by the insertion of metallic oil recovery wells placed at strategic points within a larger hydraulic field. These wells, such as wells 98 and 100, act as shorting posts across the waveguide and are used to shape the electromagnetic energy distribution within the waveguide.

The design of the electrical exciter, along with the effective waveguide dimensions and the operating frequency of the electromagnetic wave determine the mode of excitation and consequently the energy distribution throughout the waveguide. This, in turn, determines the temperature distribution within the stratum of the waveguide. The electromagnetic power input along this distribution determines the heating rate.

As with the other systems depicted above, the R.F. heating system depicted in FIG. 4 heats in substantially a circle in the absence of any shorting wells. However, if a sufficiently large field is present, a pattern of wells are provided such as depicted in FIG. 5.

Figure 5:
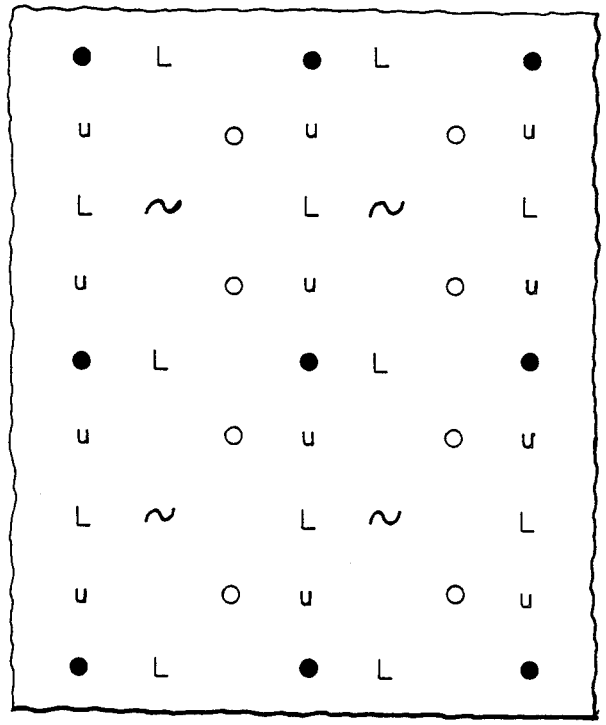
FIG. 5 is a schematic plan view of a waveguide embodiment of the present invention which is used to develop a number of segments of a deposit.

In FIG. 5, a plan view of a pattern of wells for a very large oil shale deposit is depicted. In the oil shale deposit, very large sheets of hydrofrac fluid have been utilized to create a parallel plate waveguide beneath the surface. By a judicious choice of shorting production wells and exciter wells, separate areas of the deposit can be selectively retorted. In addition, arrays of areas can be retorted as desired. It should also be appreciated that the well used to create the hydraulic fracture of the upper plate can also be later drilled deeper into the deposit and used for confining the wells and for oil production.

The methods of recovering valuable constituents from underground hydrocarbonaceous deposits according to the present invention are particularly energy effective. In the first instance, since the present methods do not require R.F. heating alone, R.F. heating can be scheduled to occur during off peak power periods when electricity can be cheaply bought from existing power sources. In addition, the creation of horizontal plates by hydraulic fracture is orders of magnitude cheaper than the prior art method of drilling holes and inserting electrodes therein. Furthermore, with R.F. retorting conditions, the off gas is high BTU and very marketable since many gas lines already run to the locations where oil shale deposits are located.

It should also be appreciated that the method of the present invention is best applied to a rich shale field. While this is true of all such processes, the fundamental advantage of the present invention is that advanced geographical areas of oil shale which have been previously unprofitable to exploit can now be profitably exploited. In addition, the use of hydraulic fractures to prepare a deposit for R.F. heating is ideally suited to large fields of oil shale where the whole field is ultimately to be combustion retorted as well. Furthermore, a large field recovery (using multiple injection wells similar to oil field recovery technique) prevents most of the losses of gas and product oil.

The present invention provides a recovery strategy of combined R.F. heating and combustion heating which is inherently more economical than either process used alone. It is very unprofitable to use expensive electrical power to R.F. heat lean areas. Similarly, it is also very unprofitable to combustion retort rich shale as oil yield losses of 30 to 40% are common. With the present process, R.F. heating of the rich oil provides at least 90% oil yield and combustion retorting is used to retort the lean oil shale. Therefore, the total oil yield is optimized.

Although the present invention has been described with respect to exemplary embodiments thereof, it will be understood by those of ordinary skill in the art that variations and modifications can be effected within the scope and spirit of the invention.

We claim:

1. A method for extracting valuable constituents from underground hydrocarbonaceous deposits such as oil shale comprising the steps of:

drilling a hole into but not beyond a stratum which contains a rich deposit of valuable constituents;

hydraulically fracturing the stratum which contains the deposit to form a single horizontally extending fracture plane located at the bottom of the hole;

injecting a liquid and conducting proppant into the fracture plane to form a horizontal liquid plate;

introducing electrical excitations to the stratum adjacent the liquid plate;

continuing the electrical excitation to retort the stratum along the liquid plate; and recovering valuable constituents from the stratum adjacent the liquid plate.

2. A method for extracting valuable constituents as claimed in claim 1 and further including the steps of combustion retorting the deposit adjacent the stratum after the recovery of valuable constituents generated by the electrical retorting and the further recovering of valuable constituents from the stratum.

3. A method for extracting valuable constituents as claimed in claim 2 and further including the step of explosively fracturing the deposit adjacent the stratum prior to the combustion retorting step to decrease voids in the electrically retorted stratum and to increase the voids in the remainder of the deposit adjacent the stratum.

4. A method for extracting valuable constituents as claimed in claim 3 and further including the step of combustion retorting the stratum prior to the explosive fracturing step to generate additional voids in the stratum.

5. A method for extracting valuable constituents as claimed in claim 1 wherein the liquid injected into the fracture plane is a good conductor such that the injecting step includes the step of forming a horizontal plate in the fracture plane.

6. A method for extracting valuable constituents as claimed in claim 5 and further including the step of connecting an electrical excitation device to the conductor plate such that the stratum retorted is adjacent both sides of the conductor plate.

7. A method for extracting valuable constituents as claimed in claim 6 and further including the step of selecting the frequency of the electrical excitation such that only the stratum is retorted.

8. A method for extracting valuable constituents as claimed in claim 5 and further including the steps of:

drilling a second hole at least to but not beyond the stratum and at a depth different from the the first hole, hydraulically fracturing the stratum at a second location to form a second horizontally extending fracture plane located at the bottom of the second hole and vertically spaced from the first-mentioned fracture plane, and injecting a good conducting liquid into the second fracture plane to form a second horizontal conductor plate; and wherein the introducing of electrical excitations step includes the step of electrically coupling the first-mentioned conductor plate and the second conductor plate to an electromagnetic generator such that the stratum retorted lies primarily between the first-mentioned conductor plate and the second conductor plate.

9. A method for extracting valuable constituents as claimed in claim 5 and further including the steps of:

drilling second and third holes which terminate at outer boundaries of the stratum, hydraulically fracturing the stratum at second and third locations to form second and third horizontally extending fracture planes located at the bottom of the second and third holes and vertically spaced from the first-mentioned fracture plane and on opposite sides thereof, and injecting a conducting fluid into the second and third fracture planes to form second and third horizontal conductor plates; and wherein the introducing of electrical excitations step includes the step of electrically coupling the middle of the three conductor plates and the outer two conductor plates to an electromagnetic generator such that the stratum retorted lies between the outer conductor plates.

10. A method for extracting valuable constituents as claimed in claim 5 and further includes the steps of:

drilling a second hole at least to but not beyond the stratum, hydraulically fracturing the stratum at a second location to form a second horizontally extending fracture plane located at the bottom of the second hole and vertically spaced from the first-mentioned fracture plane, and injecting a good conducting liquid into the second fracture plane to form a second horizontal conductor plate such that the first-mentioned conductor plate and the second conductor plate form a horizontally extending waveguide; and wherein the introducing of electrical excitations step includes the step of positioning an antenna in the waveguide such that the stratum retorted lies principally between the first-mentioned and second conductor plates.

11. A method for extracting valuable constituents as claimed in claim 1 wherein the liquid injected into the fracture plane has a high dielectric constant; and further including the steps of:

drilling a second hole which terminates at an outer boundary of the stratum, hydraulically fracturing the stratum at a second location to form a second horizontally extending fracture plane located at the bottom of the second hole and vertically adjacent the first-mentioned fracture plane, and injecting a high dielectric constant liquid into the second fracture plane to form a horizontally extending waveguide between the two liquid filled fracture planes; and wherein the introducing of electrical excitations step includes the step of positioning an antenna in the waveguide such that the stratum retorted lies principally between the two fracture planes.

12. A method for extracting valuable constituents as claimed in claim 11 and further including the step of shaping the excitations in the waveguide to a predetermined horizontal area by drilling a plurality of wells to the lower fracture plane and then by shorting the waveguide with the wells in a predetermined pattern.

13. A method for extracting valuable constituents as claimed in claim 12 and further including the step of recovering the valuable constituents through the shorting wells.

14. A method for extracting valuable constituents as claimed in claim 13 and further including the step of drilling a plurality of recovery wells to the upper fracture plane for recovering the valuable constituents.

15. A method for extracting valuable constituents as claimed in claim 1 and further including the step of initially coring the deposit to locate the strata at which rich deposits are present.

16. A method for extracting valuable constituents from an underground staratum containing hydrocarbonaceous deposits including the steps of:

forming a single substantially horizontally extending fracture plane in the stratum by hydraulically fracturing the stratum at a lower end of a hole extending at least to but not beyond the stratum;

injecting a conducting liquid into the fracture plane to form a substantially horizontal conductor plate;

introducing electrical excitations to the stratum adjacent the conductor plate;

continuing the electrical excitations to the stratum adjacent the conductor plate;

continuing the electrical excitation to retort the stratum along the conductor plate; and recovering valuable constituents from the stratum adjacent the conductor plate.

17. The method of claim 16, wherein the fracture plate is formed substantially centrally in the stratum.

18. The method of claim 17, additionally including the steps of:

forming a second and a third substantially horizontally extending fracture planes in the stratum by hydraulically fracturing the stratum at a lower end of second and third holes which terminate at outer boundaries of the stratum, said second and third fracture planes being vertically spaced from and on opposite sides of the first-mentioned fracture plane; and injecting into the second and third fracture planes a conducting liquid to form second and third substantially horizontal conductor plates; and wherein the step of introducing electrical excitations to the stratum includes the step of electrically coupling the second and third conductor plates to the first-mentioned conductor plate such that the stratum retorted lies primarily between the second and third conductor plates.

19. The method of claim 16, wherein the fracture plane is formed at an upper substantially horizontal boundary of the stratum, and additionally including the steps of:

forming a second substantially horizontally extending fracture plane at a lower substantially horizontal boundary of the stratum by hydraulically fracturing the stratum at a lower end of a second hole which extends to but not beyond the lower boundary;

injecting into the second fracture plane a conducting liquid to form a second substantially horizontal conductor plate; and electrically coupling the second conductor plate to the first-mentioned conductor plate such that the stratum retorted lies primarily between the conductor plates.

20. The method of claim 19, wherein the step of electrically coupling the conductor plates includes the step coupling each of the conductor plates to an electromagnetic generator such that electrical excitations generated by the generator are radiated by the conductor plates into the stratum causing retort of the stratum.

* * * * *